US005924581A

United States Patent [19]

Chen

[11] Patent Number: 5,924,581

[45] Date of Patent: Jul. 20, 1999

[54] EASY-MOUNT SHELF HOLDER FOR A SECTIONAL RACK

[75] Inventor: Henry Chen, Taipei, Taiwan

[73] Assignee: Protrend Co., Ltd., Taipei, Taiwan

[21] Appl. No.: 09/164,912

[22] Filed: Oct. 1, 1998

Related U.S. Application Data

[51] Int. Cl.[6] ..... A47B 57/00

[52] U.S. Cl. ..... 211/187; 211/181.1; 108/107; 108/192

[58] Field of Search ..... 211/187, 181.1; 108/147.12, 147.15, 147.11, 158.11, 107, 106, 56.3, 56.1, 16, 12, 192; 403/373; 182/186.8

[56] References Cited

U.S. PATENT DOCUMENTS

| | | | |
|---|---|---|---|
| 4,750,626 | 6/1988 | Nicely | 108/192 X |
| 4,799,818 | 1/1989 | Sudimak et al. | 211/187 X |
| 5,127,342 | 7/1992 | Taylor | 211/187 X |
| 5,415,302 | 5/1995 | Carlson et al. | 211/187 |
| 5,531,167 | 7/1996 | Stevens et al. | 108/106 |

*Primary Examiner*—Daniel P. Stodola
*Assistant Examiner*—Erica B. Harris
*Attorney, Agent, or Firm*—W. Wayne Liauh

[57] ABSTRACT

An easy-mount shelf holder for a sectional rack. The rack includes upright posts having spaced annular grooves for externally tapered sleeves attached thereto and shelves supported by shelf holders mounted around the sleeves. Each shelf holder includes a main part formed from a bar portion and a partially opened gripping ring portion provided at one end of the bar portion, and a cooperative part formed from an arm portion and a seal portion provided at an outer end of the arm portion. The cooperative part is pivotally connected at an inner end of the arm portion to the bar portion of the main part, such that when the cooperative part is turned toward the main part, the seal portion closes the partially opened gripping ring portion to define a complete and internally tapered ring portion suitable for tightly enclosing the tapered sleeve on the posts. An arcuate extension of the seal portion firmly abuts against a part of outer wall of the sleeve some distance away from the seal portion when the sleeve is tightly clamped by the ring portion, preventing the seal portion from easily disengaging from the gripping ring portion. The position of the shelf holder on the post can be adjusted by simply pivoting the cooperative part away from the main part to loosen the seal portion and the gripping ring portion from the sleeve.

2 Claims, 8 Drawing Sheets

EASY-MOUNT SHELF HOLDER FOR A SECTIONAL RACK

BACKGROUND OF THE INVENTION

The present invention relates to an easy-mount shelf holder for a sectional rack. Such shelf holders can be easily and quickly fixed onto and around upright posts of the rack for supporting shelves thereon to conveniently complete erection of the sectional rack.

Sectional racks in early stages included posts and shelves assembled together by means of screws or bolts. Later, posts for such sectional racks are improved so that no screws or bolts or other fastening means are needed to assemble the posts and the shelves. FIG. 1 illustrates an improved sectional rack in which each post 10 is provided around its circumferential surface with axially spaced annular grooves 13. Individual sleeves 11 each consisting of two mated halves and having inner flanges 14 projected inward from suitable positions can be separately fixedly mounted around the posts 10 by engaging their respective inner flanges 14 into selected annular grooves 13 on the posts 10. The sleeve 11 formed from the two mated halves has a tapered outer surface. That is, the sleeve 11 each has outer diameter that gradually increases from top to bottom. Individual screen-type or other types of shelves 12 for holding articles thereon each has four gripping rings 15 (only one gripping ring is shown in FIG. 1) separately provided at four corners of the shelf. The gripping ring 15 defines a tapered inner space. That is, the gripping ring 15 has an internal diameter that is gradually increasing from top to bottom for fitting over and around the tapered sleeve 11 in a tight fit manner, so that the tapered sleeves 11 are firmly clamped to tighten around the posts 10, so that the shelves 12 are assembled to and supported by the posts 10 via the gripping rings 15.

In the event multiple layers of shelves are to be arranged for the rack, the shelves 12 can only be sequentially assembled to the posts 10 one by one by separately fixing the gripping rings 15 at four corners of each shelf 12 around the tapered sleeves 11 on the posts 10 by putting the gripping rings 15 from tops of the posts 10. To increase or decrease the layers of shelves 12 on the rack, it is a necessary step to remove a top layer of shelf 12 from the posts 10. It is, of course, troublesome and difficult to do so each time there is any shelf 12 to be mounted or removed. U.S. Pat. Nos. 5,676,263; 5,303,645; 5,174,676; 4,991,725; 4,799,818; 4,595,107; 4,546,887; and 4,763,799 all disclose such conventional rack using upright posts with annular grooves.

SUMMARY OF THE INVENTION

It is a primary object of the present invention to provide an easy-mount shelf holder for a sectional rack to eliminate drawbacks existing in the complicated assembling of shelves to the upright posts of the conventional rack. Numbers of shelves on the rack can be more easily and conveniently increased or decreased simply by adjusting positions of the shelf holders on the posts.

The shelf holder according to the present invention mainly includes a main part formed from a bar portion and a partially opened gripping ring portion provided at one end of the bar portion, and a cooperative part formed from an arm portion and a seal portion provided at outer end of the arm portion. The cooperative part is pivotally connected at an inner end of the arm portion to the bar portion of the main part, such that when the cooperative part is turned toward the main part, the seal portion closes the partially opened gripping ring portion to define a complete and internally tapered ring for seating on and tightly enclosing one externally tapered sleeve fixed around the posts. An arcuate extension of the seal portion firmly abuts against outer surface at another side of the tapered sleeve when the seal portion tightly closes the partially opened gripping ring portion, preventing the seal portion from easily disengaging from the gripping ring portion. Position of the shelf holder on the post can be easily adjusted simply by pivotally turning the cooperative part away from the main part to loosen the seal portion from the gripping ring portion for the latter to release from the tapered sleeve on the post.

Since the internally tapered ring formed from the engaged gripping ring portion and seal portion has an inner diameter larger than the outer diameter of the post, the arcuate extension will not be obstructed by an outer wall of the post when the cooperative part is turned toward the main part to enclose the tapered sleeve around the post. The gripping ring portion and the seal portion can therefore together form a complete ring to firmly and tightly clamp the tapered sleeve 11.

DETAILED DESCRIPTION OF THE PREFERRED EMBODIMENTS

Figure 1:
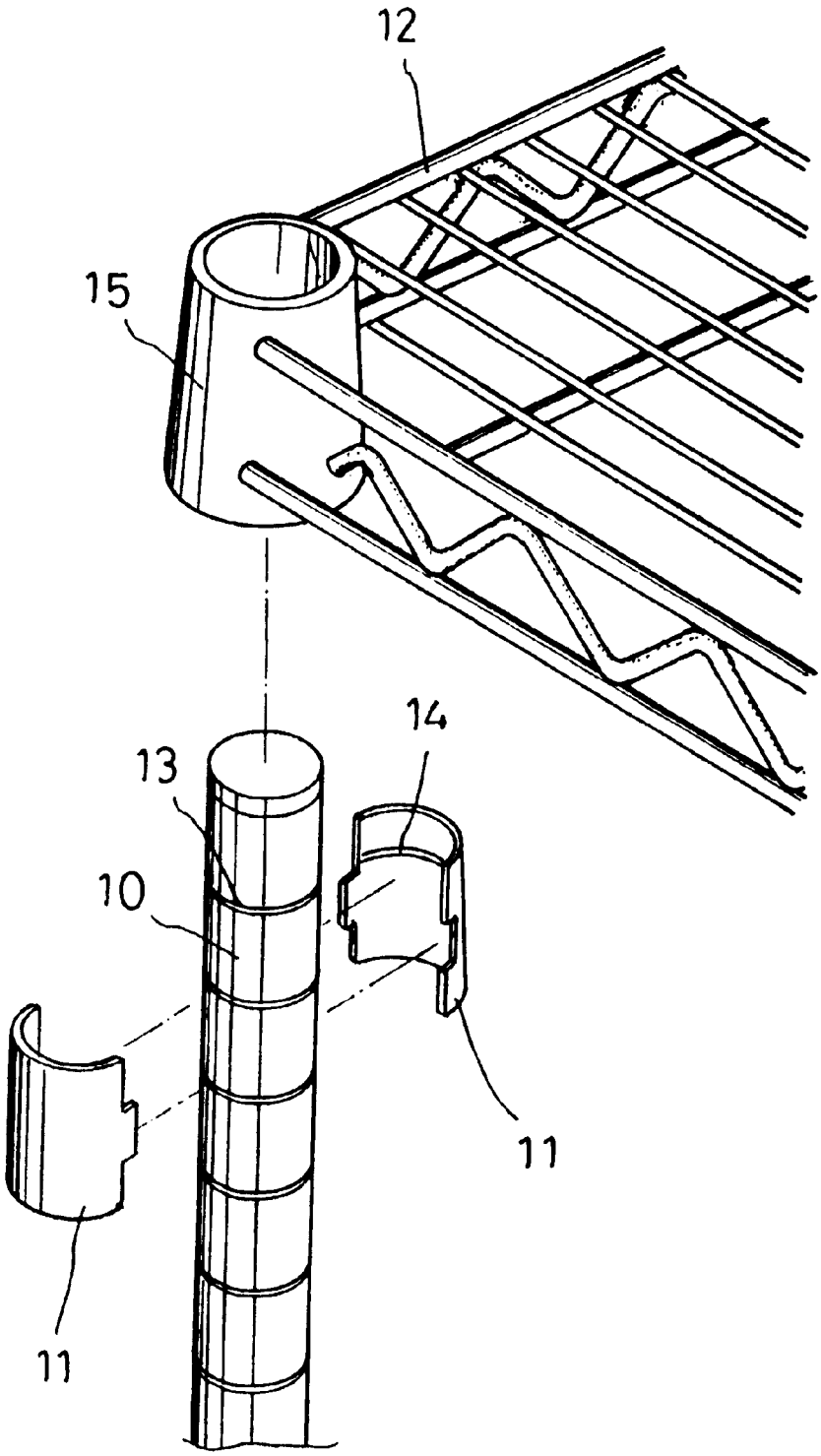
F I G·1 (Prior Art)
FIG. 1 is a fragmentary, exploded perspective showing a conventional shelf for a sectional rack.

The present invention relates to an easy-mount shelf holder for a sectional rack, wherein the sectional rack includes multiple upright posts 10 and sleeves 11 as that shown in FIG. 1. Axially spaced annular grooves 13 are formed around outer circumferential surface of each post 10 and individual externally tapered sleeves 11 maybe selectively mounted around the posts 10 by engaging internal flanges 14 of the sleeves 11 with selected annular grooves 13 on the posts 10. To allow more than one shelf to be easily mounted onto or dismounted from the posts 10 of the sectional rack, the present invention provides an easy-mount shelf holder that mainly includes a main part 20 and a cooperative part 30.

Figure 2:
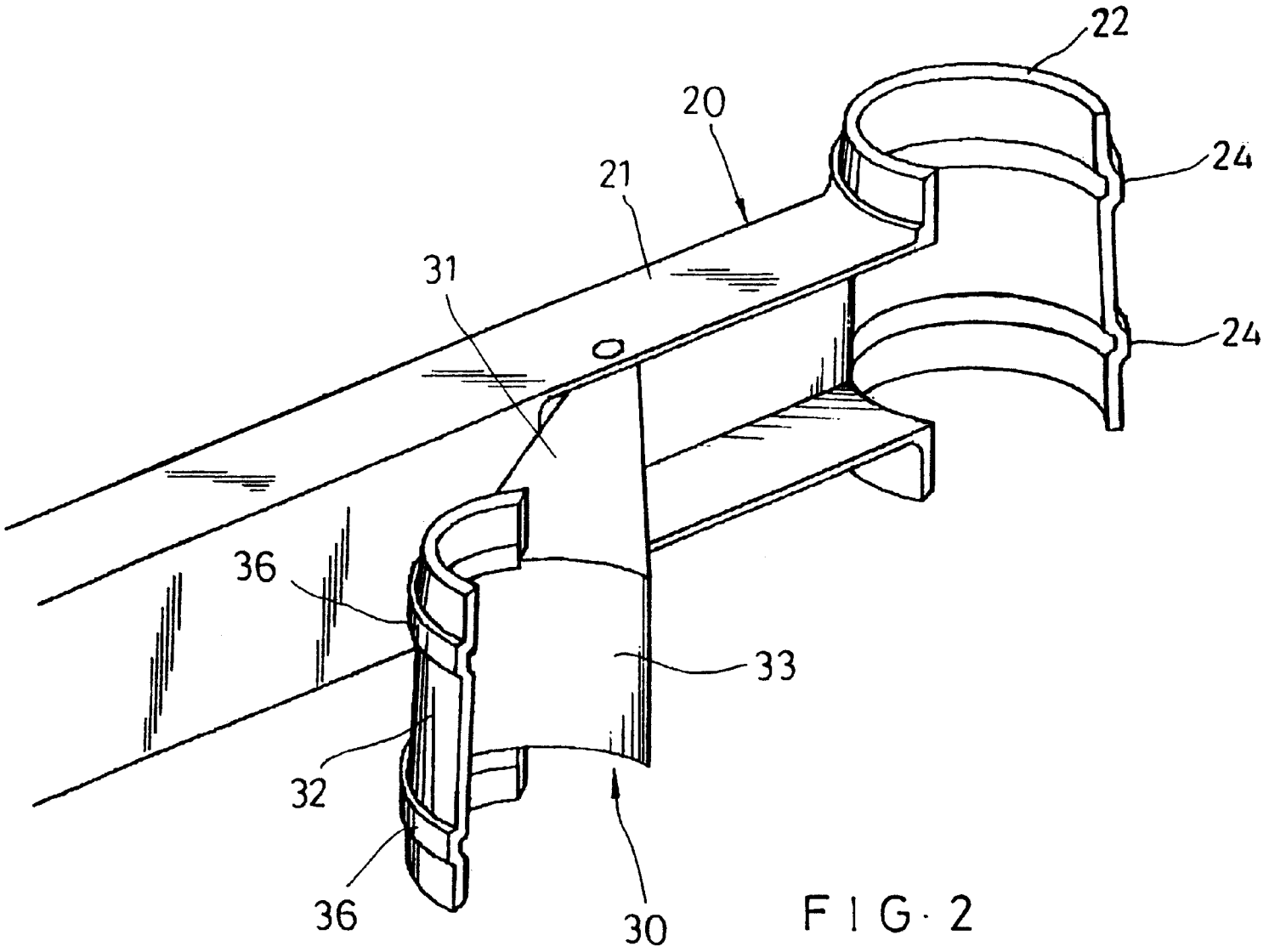
FIG. 2 is a fragmentary perspective showing a preferred embodiment of the easy-mount shelf holder for a sectional rack according to the present invention, wherein the cooperative part of the shelf holder is turned away from the main part of the shelf holder.
Figure 3:
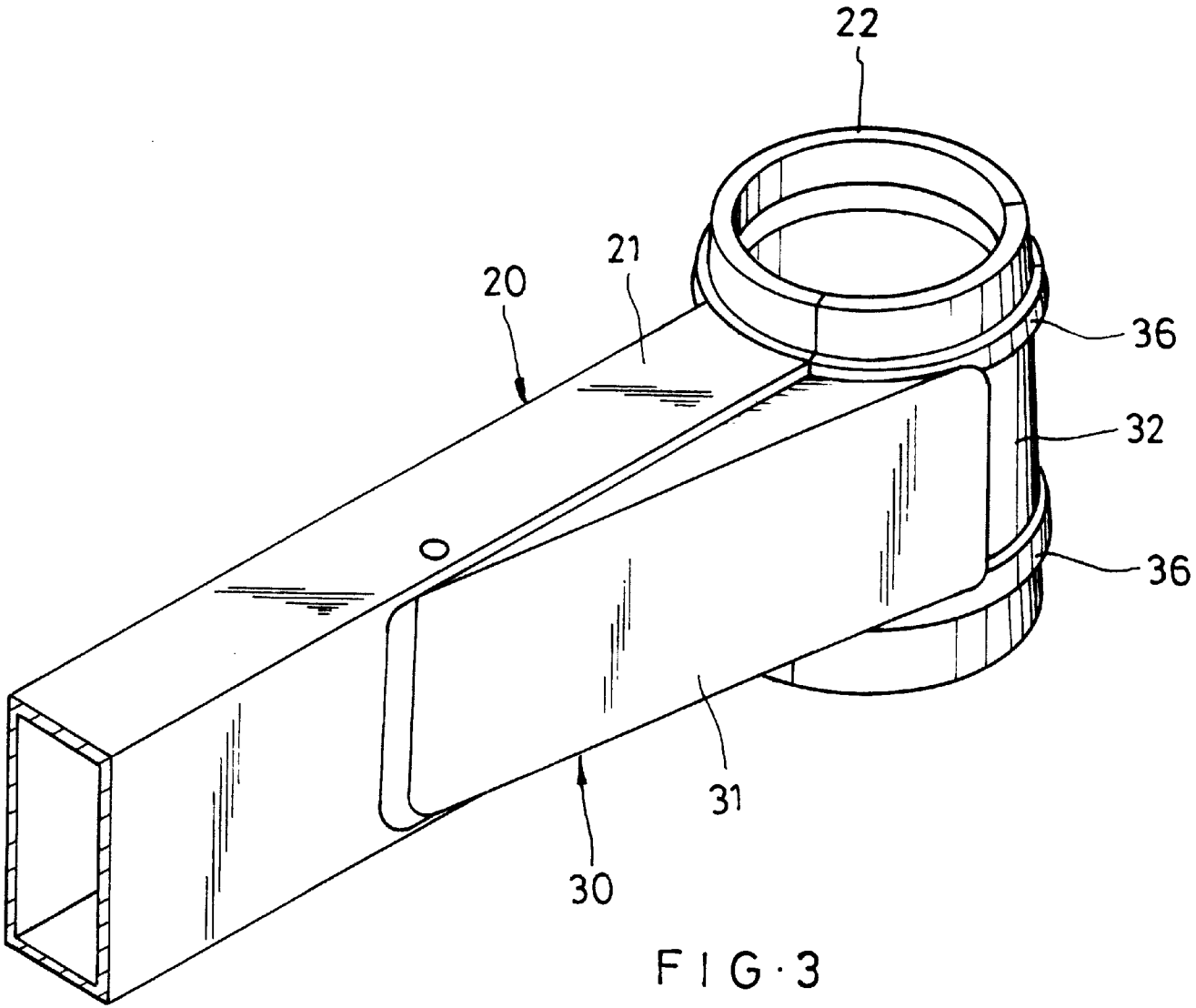
FIG. 3 is similar to FIG. 2 but with the cooperative part engaged with the main part of the shelf holder.

Please refer to FIGS. 2 and 3 in which a one-end shelf holder according to a first embodiment of the present invention is shown. The main part 20 of the one-end shelf holder includes a short horizontal bar portion 21 and a gripping ring portion 22 provided at a first end of the bar portion 21. A part of the gripping ring portion 22 to an inner side of the bar portion 21 is cut away to form an axially extended opening which has a width larger than an external diameter of the post 10 but smaller than an external diameter of the tapered sleeve 11. The cooperative part 30 includes an arm portion 31 and a seal portion 32 integrally formed at an outer end of the arm portion 31. The cooperative part 30 is pivotally connected at an inner end of the arm portion 31 to the bar portion 21 of the main part 20, such that when the cooperative part 30 is horizontally pivotally turned toward the main part 20, the seal portion 32 thereof will finally closely cover the opening of the gripping ring portion 22 of the main part 20 to together form a complete and internally tapered ring portion.

An arcuate extension 33 extends from an inner edge of the seal portion 32 toward the gripping ring portion 22 of the mainpart 20. When the cooperative part 30 is turned toward the main part 20 so that the seal portion 32 and the gripping ring portion 22 together clamp a sleeve 11 previously fixed around a post 10, the arcuate extension 33 shall extend to abut against a part of outer wall surface of the sleeve 11 some distance away from the seal portion 32 to facilitate tight engagement of the seal portion 32 with the opening of the gripping ring portion 22, so that the sleeve 11 and the post 10 are firmly clamped between the main part 20 and the cooperative part 30 of the shelf holder.

Figure 5:
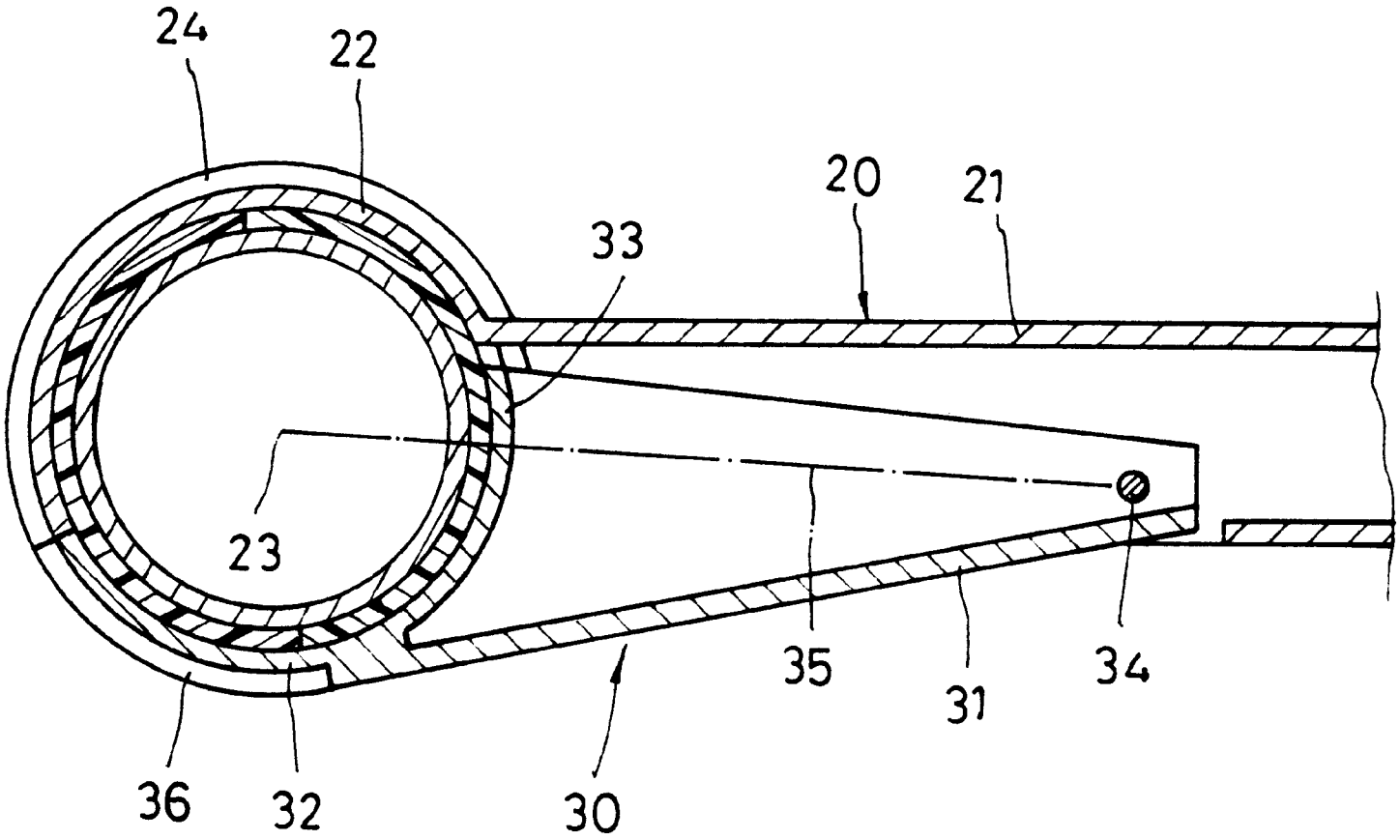
FIG. 5 is a fragmentary, sectional view showing the shelf holder of the present invention closely fixed around the tapered sleeve on the post of the rack.

Please go to FIG. 5. The arcuate extension 33 of the cooperative part 30 must be long enough to cross a line 35 extending between a center 23 of the gripping ring portion 22 and a pivot axis 34 of the arm portion 31 of the cooperative part 30 to extend and abut against another side of the tapered sleeve 11. The longer the portion of the arcuate extension 33 crossing the line 35 is, the tighter the seal portion 32 can engage with the opening of the gripping ring portion 22 to close around the sleeve 11.

Since the complete and internally tapered ring portion enclosed by the gripping ring portion 22 and the seal portion 32 has inner diameter larger than the outer diameter of the post 10, the arcuate extension 33 will not be obstructed by an outer wall of the post 10 when the cooperative part 30 is turned toward the main part 20 to enclose the post 10. Meanwhile, the length of the arcuate extension 33 is so designed that it would allow the seal portion 32 and the gripping ring portion 22 to fitly and firmly engage with each other to define a closed space between them. When the gripping ring portion 22 and the seal portion 32 of the shelf holder of the present invention are put around the sleeve 11, the arcuate extension 33 of shelf holder abutting on the sleeve 11 is outward pushed by the wall of the sleeve 11 exceeding the line 35. This outward push force applied on the arcuate extension 33 by the sleeve 11 in turn pulls the seal portion 32 of the cooperative part 30 of the shelf holder inward to firmly seal the opening of the gripping ring portion 22 of the main part of the shelf holder. The firm contact of the seal portion 32 with the gripping ring portion 22 makes the shelf holder of the present invention tightly seat around the sleeve 11.

The ring portion defined by the closed gripping ring portion 22 and seal portion 32 has internally tapered inner wall corresponding to the tapered outer surface of the sleeve 11 to allow tight fit between two inclined surfaces. To permit the shelf holder of the present invention to have enhanced structural strength, outward projected ribs 24 and 36 are provided along outer wall surfaces of the gripping ring portion 22 and the seal portion 32, respectively.

Figure 4:
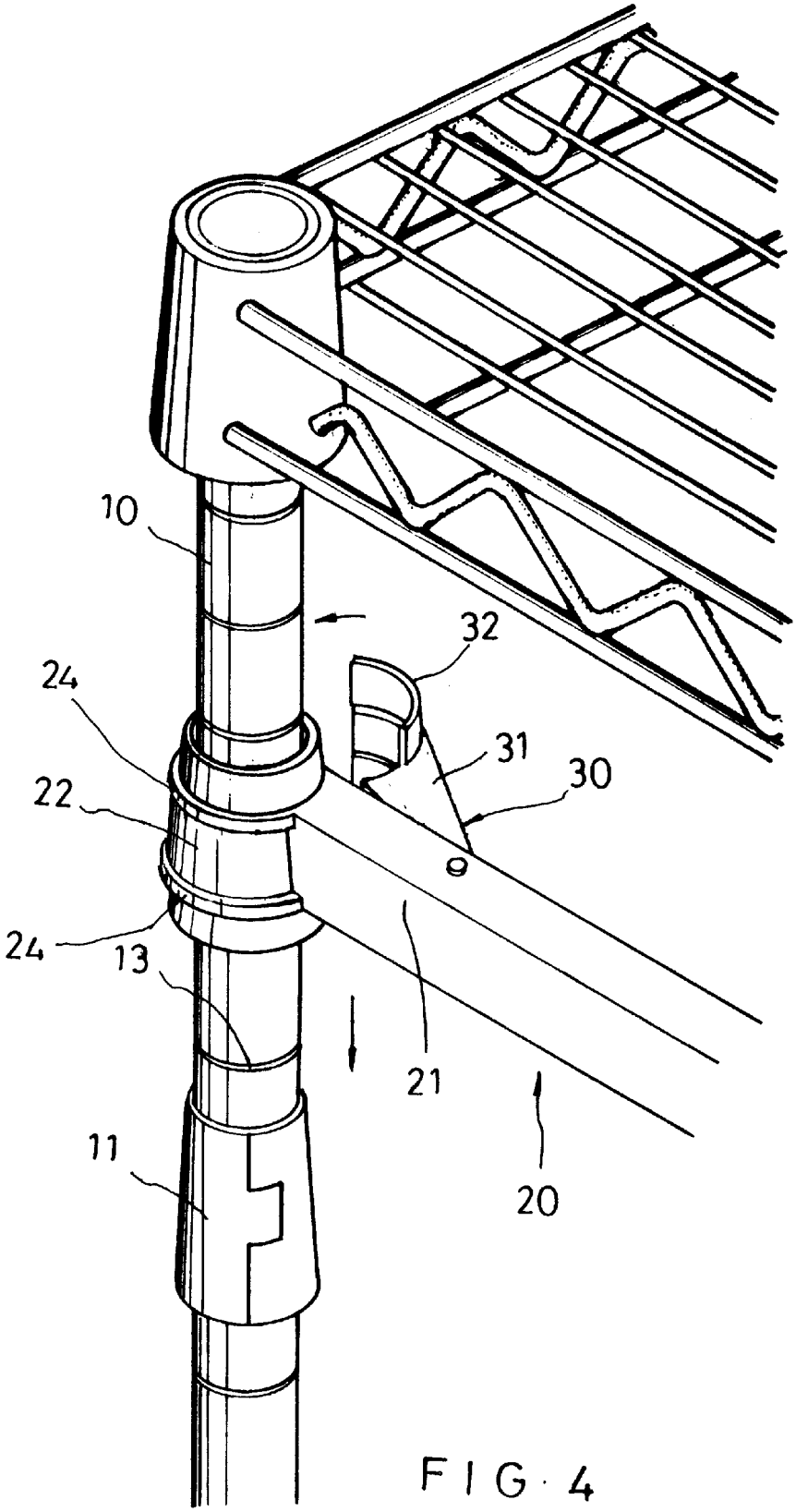
FIG. 4 illustrates the manner in which the shelf holder of the present invention is assembled to a post of the rack.

Please now refer to FIG. 4. To mount shelf holders of the present invention on posts 10 to support shelves and complete a sectional rack, first bring one shelf holder toward one post 10, such that the post 10 is located in the gripping ring portion 22 of the main part 20 via the opening of the gripping ring portion. Then, the cooperative part 30 of the shelf holder is pivotally turned toward the main part 20 for the seal portion 32 to fully engage with the opening of the gripping ring portion 22. The shelf holder is then moved downward along the post 10 to firmly locate over one sleeve 11 and tightly enclose the latter. To relocate, replace or remove any shelf on the rack, simply sequentially sideward turn the cooperative part 30 away from the main part 20 of each shelf holder supporting the shelf to loosen all the related shelf holders from the associated sleeves 11, so that the shelf holders and the shelf held by them can be directly moved upward or downward along or be removed from the posts 10 without the need to dismount the top layer of shelf from the posts 10.

In another embodiment of the present invention, a two-end shelf holder is provided. Each two-end shelf holder has a main part 20 including an extended bar portion 21 and two gripping ring portions 22 separately provided at two ends of the bar portion 21, as well as two cooperative parts 30 separately pivotally connected to the main part 20 near the gripping ring portions 22 in a manner as that in the first embodiment of the present invention.

Figure 6:
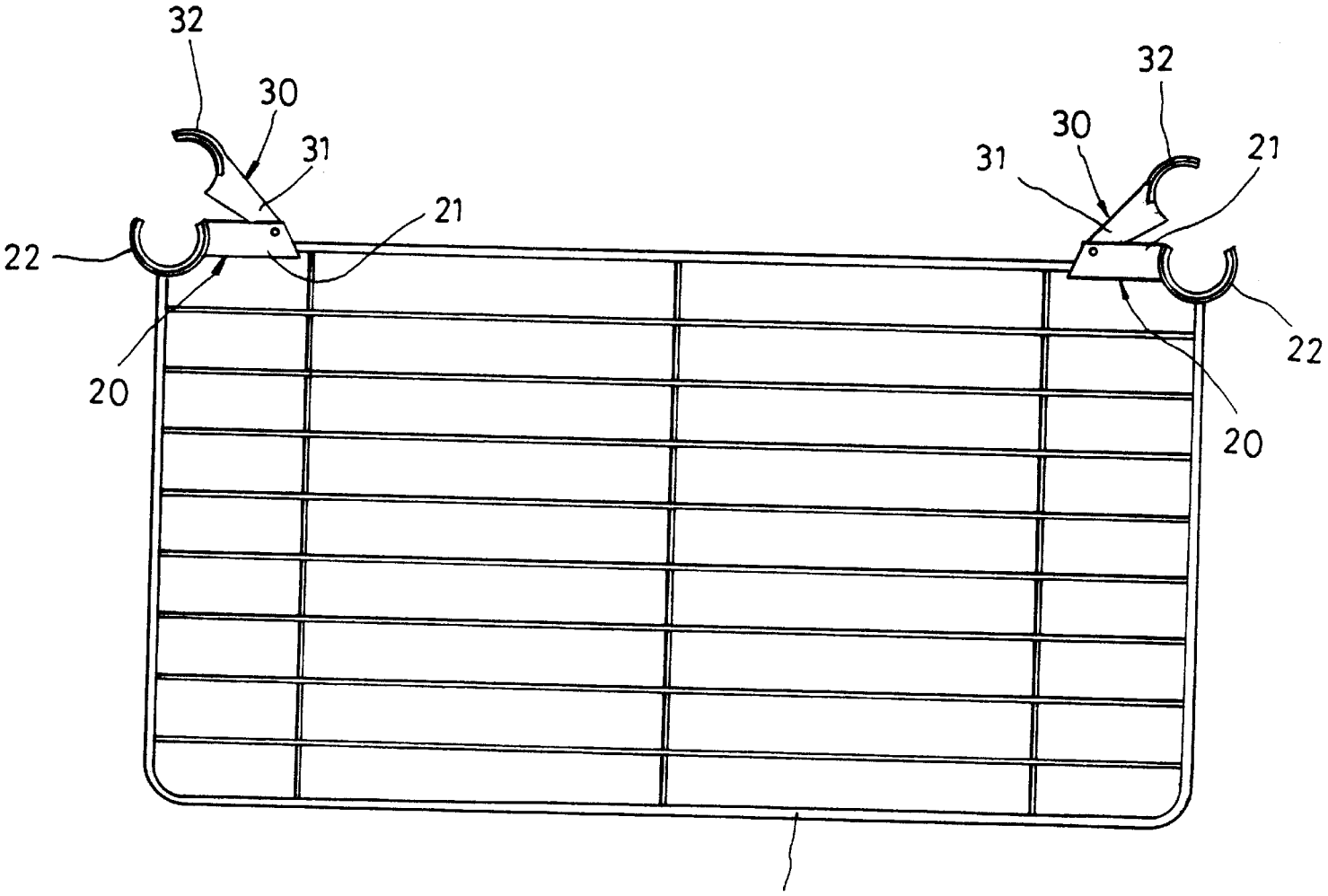
FIG. 6 shows an example of the use of the shelf holders of FIG. 2 to hold a screen-type shelf.

FIG. 6 illustrates that two one-end shelf holders according to the first embodiment of the present invention are used to hold a screen-type shelf 40 by welding the shelf 40 to the shelf holders between two bar portions 21 thereof. Then, by means of the two one-end shelf holders welded to the shelf 40, the shelf 40 can be mounted on the posts 10 of the sectional rack at any desired height by fixing the shelf holders to the posts 10 in the above-mentioned manner.

Figure 7:
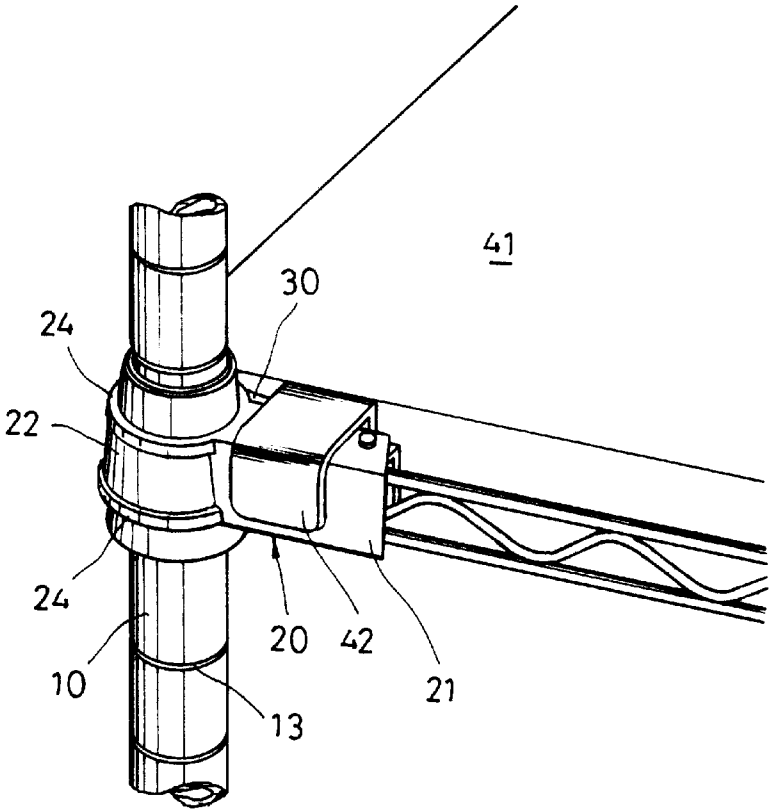
FIG. 7 is a fragmentary perspective showing a two-end easy-mount shelf holder according to another embodiment of the present invention in which two gripping ring portions and two cooperative parts are separately provided at two ends of an extended bar portion.

Each two-end shelf holder according to the second embodiment of the present invention may be mounted to and between two posts 10 erected at each side of the sectional rack at a desired height. A shelf 41 having hooks 42 provided at two lateral edges thereof can be directly laid over the bar portions 21 of the two-end shelf holders mounted on posts 10 at two sides of the rack. FIG. 7 shows only one corner of the shelf 41 supported by the two-end shelf holder mounted onto posts 10 of the rack. To ensure the shelf 41 in a completely horizontal position, the two-end shelf holders mounted onto posts 10 at two sides of the rack must be fixed at the same height on the posts 10.

Figure 8:
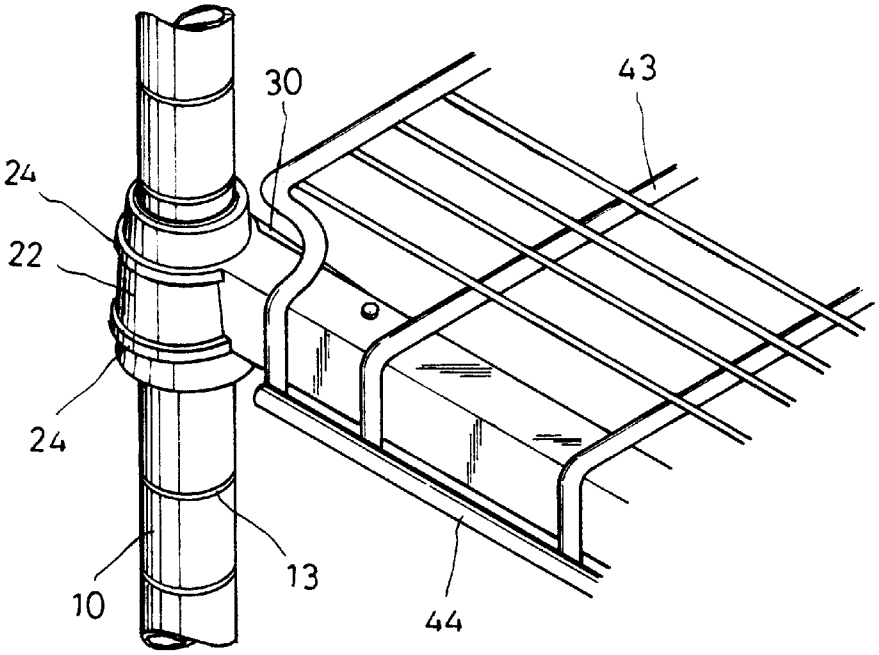
FIG. 8 shows another example of the use of the two-end easy-mount shelf holder of the present invention to support a shelf.

FIG. 8 illustrates another example of using the two-end shelf holder of the present invention. As shown, a shelf 43 (only a corner of which is shown in the drawing) having angled portions 44 provided at two edges thereof can be laid over the two-end shelf holders fixed to posts 10 at two sides of the rack by hooking the angled portions 44 of the shelf 43 at the bar portions 21 of the shelf holders.

Figure 9:
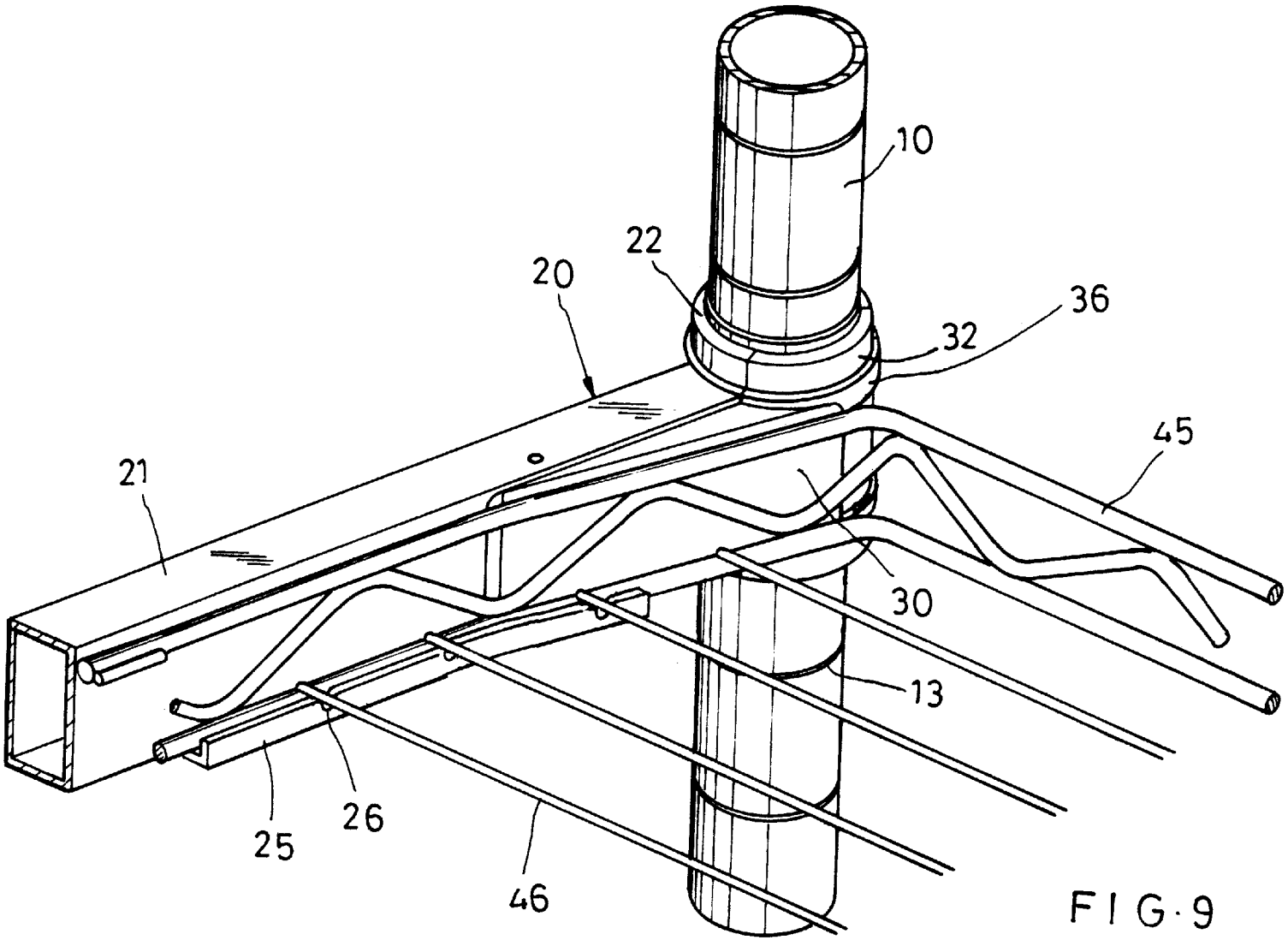
FIG. 9 shows a further example of the use of the two-end easy-mount shelf holder of the present invention to support a shelf.

In a variation of the two-end shelf holder of the present invention, more than two retaining means 25 are provided on the bar portion 21 at suitable positions, so that a screen-type shelf 45 may be supported on the shelf holders between two bar portions 21 by directly engaging edge members of the shelf 45 into the retaining means 25 on the bar portions 21, as partially shown in FIG. 9. To further ensure stable positioning of the shelf 45 on the shelf holders, some of the bar members 46 forming the shelf 45 maybe located into notches 26 formed on the retaining means 25.

What is claimed is:

1. A shelf holder for a sectional rack, said sectional rack including upright posts with axially spaced annular grooves formed on outer circumferential surfaces thereof, and externally tapered sleeves having outer diameter gradually increased from top to bottom for firmly attaching to said posts by engaging inner flanges of said sleeves into said annular grooves around said posts, said shelf holder each comprising:

a main part including a bar portion and at least one gripping ring portion connected to at least one end of said bar portion, a part of said gripping ring portion to an inner side of said bar portion being cut away to form an axially extended opening that has a width larger than an external diameter of each said post but smaller than an external diameter of said externally tapered sleeve; and at least one cooperative part pivotally connected to said bar portion of said main part, said at least one cooperative part including an arm portion and a seal portion connected to an outer end of said arm portion and having an arcuate extension projecting inward toward said gripping ring portion of said main part; said at least one cooperative part being connected at an inner end of said arm portion to said bar portion of said main part, such that when said cooperative part is horizontally pivotally turned toward said main part, said seal portion thereof finally engages with and closely covers the opening of said gripping ring portion of said main part to together with said gripping ring portion define a complete ring portion for tightly clamping said tapered sleeve therein; said arcuate extension of said seal portion being long enough to cross a line extending between a center of said gripping ring portion of the main part and a pivot axis of said arm portion of said cooperative part, such that when said seal portion is pivotally turned to close the opening of said gripping ring portion and thereby firmly enclose one of said tapered sleeves on said posts, said arcuate extension extends to abut against a part of outer wall of said tapered sleeve some distance away from said seal portion, preventing said seal portion from easily disengaging from said gripping ring portion, whereby said shelf holder with said main and said cooperative parts in an engaged state is tightly and stably mounted around said sleeve for supporting a shelf.

2. A shelf holder for a sectional rack as claimed in claim 1, wherein each said complete ring portion defined by said gripping ring portion and said seal portion in engaged state has tapered inner wall gradually expanded from top to bottom corresponding to said externally tapered sleeve to allow tight fit between said shelf holder and said sleeve; and wherein said gripping ring portion and said seal portion are provided around their outer surfaces with outward projected ribs to increase structural strength of these portions.

* * * * *